US005538042A

United States Patent [19]

Baland

[11] Patent Number: 5,538,042

[45] Date of Patent: Jul. 23, 1996

[54] AIR DRIVEN DEVICE

[75] Inventor: Kerry W. Baland, Calimesa, Calif.

[73] Assignee: Wilden Pump & Engineering Co., Grand Terrace, Calif.

[21] Appl. No.: 475,766

[22] Filed: Jun. 7, 1995

Related U.S. Application Data

[62] Division of Ser. No. 65,632, May 21, 1993, Pat. No. 5,441, 281.

[51] Int. Cl.[6] ..... F16K 3/26

[52] U.S. Cl. ..... 137/625.63; 91/307; 251/324; 251/900

[58] Field of Search ..... 91/307; 137/625.63, 137/625.69; 251/324, 900

[56] References Cited

U.S. PATENT DOCUMENTS

| | | | |
|---|---|---|---|
| D. 275,858 | 10/1984 | Wilden | D15/7 |
| D. 294,946 | 3/1988 | Wilden | D15/7 |
| D. 294,947 | 3/1988 | Wilden | D15/7 |
| 2,747,611 | 5/1956 | Hewitt | 137/625.69 |
| 3,071,118 | 1/1963 | Wilden . | |
| 3,354,911 | 11/1967 | Fall | 137/625.69 |
| 3,487,435 | 12/1969 | Sheardown | 137/625.69 |
| 3,527,257 | 9/1970 | Kling | 137/625.69 |
| 4,238,992 | 12/1980 | Tuck, Jr. | 92/103.5 |
| 4,247,264 | 1/1981 | Wilden | 417/393 |
| 4,325,402 | 4/1982 | Akkerman et al. | 137/625.69 |
| 4,549,467 | 10/1985 | Wilden et al. | 91/307 |
| 5,169,296 | 12/1992 | Wilden | 417/395 |

FOREIGN PATENT DOCUMENTS

| | | | |
|---|---|---|---|
| 0151330 | 8/1985 | European Pat. Off. | 137/625.69 |

*Primary Examiner*—Gerald A. Michalsky
*Attorney, Agent, or Firm*—Lyon & Lyon

[57] ABSTRACT

An air driven diaphragm pump having two diaphragms joined by a common control shaft to reciprocate in opposed chambers for pumping material through check valve ported cavities. An actuator valve is associated with the central housing of the pump and includes a valve cylinder within which a valve piston reciprocates. The valve piston is caused to reciprocate by alternate venting of the ends of the cylinder. Enlarged air chamber passages are controlled by the control shaft to vent the ends of the valve cylinder. A cylindrical portion of the control shaft includes axial slots for venting alternate ends of the valve piston. Annular channels manifold air to and from the axial slots. The actuator housing is molded about the center bushing for the control shaft and includes inwardly extending portions. Annular passages are then machined in the bushing for sealing channels to receive O-rings. The O-rings extend to seal against the housing directly at the floor of the sealing channels.

10 Claims, 4 Drawing Sheets

AIR DRIVEN DEVICE

This application is a division, of application Ser. No. 08/065,632, filed May 21, 1993, now U. S. Pat. No. 5,441, 281.

BACKGROUND OF THE INVENTION

The field of the present invention is air driven devices including seals for pressurized gases between a shaft and a bushing.

Pumps having double diaphragms driven by compressed air directed through an actuator valve are well known. Reference is made to U.S. Pat. Nos. 5,169,296; 4,247,264; 294,946; 294,947; and U.S. Pat. No. 275,858, all issued to James K. Wilden, the disclosures of which are incorporated herein by reference. An actuator valve operated on a feedback control system is disclosed in U.S. Pat. No. 3,071,118 issued to James K. Wilden, the disclosure of which is also incorporated herein by reference. This feedback control system has been employed with the double diaphragm pumps illustrated in the other patents.

Such pumps include an air chamber housing having a center section and two concave discs facing outwardly from the center section. Opposing the two concave discs are pump chamber housings. The pump chamber housings are coupled with an inlet manifold and an outlet manifold through ball check valves positioned in the inlet passageways and outlet passageways from and to the inlet and outlet manifolds, respectively. Diaphragms extend outwardly to mating surfaces between the concave discs and the pump chamber housings. The diaphragms with the concave discs and with the pump chamber housings each define an air chamber and a pump chamber to either side thereof. At the centers thereof, the diaphragms are fixed to a control shaft which slidably extends through the air chamber housing.

Actuator valves associated with such pumps have feedback control mechanisms including a valve piston and airways on the control shaft attached to the diaphragms. These valves alternately distribute a constant source of pressurized air into each air chamber according to control shaft location, driving the diaphragms back and forth. In turn, the pump chambers alternately expand and contract to pump material therethrough. Such pumps are capable of pumping a wide variety of materials of widely varying consistency.

FIGS. 1 and 2 illustrate a previously designed control rod or shaft and associated bushing, respectively. The shaft PA1 has a center portion having a waist PA2 of reduced cross-sectional dimension in the otherwise cylindrical shaft PA1. Axial slots are equiangularly spaced about the waist PA2 to provide added axial air flow. The associated bushing PA3 has three annular channels to either side of a central portion. The innermost and outermost channels PA4 and PA5 of each set of three receive O-rings to act as annular seals between the bushing PA3 and the shaft PA1 in order that flow may be controlled between the central annular channels PA6 and vent passages PA7.

The valving mechanism provided by the shaft PA1 and the bushing PA3 cooperates with a control valve to alternately vent either end of a shuttle piston at the ends of the stroke of the shaft PA1. The venting occurs when the waist portion PA2 spans alternately the two innermost channels PA4 to expose the central annular channels PA6 to the vent passages PA7. The waist portion PA2 provides both an axial passage capable of spanning the aforementioned seals and a circular manifold for venting annular air flow across the seal to the vent passages PA7 at either side. This arrangement has long been employed because of the need to rapidly vent the appropriate passage of the control valve.

The bushings typically employed in the foregoing pumps have been brass. Plastic bushing have also been contemplated. With certain combinations of materials for the housing and the bushing, the bushings can pull away from the housing creating leakage paths circumventing the O-ring seals. The paths would extend from a high pressure area between the bushing and the housing axially to atmosphere or to a low pressure side of the device.

SUMMARY OF THE INVENTION

The present invention is directed to a sealing mechanism in air driven devices using a shaft mounted within a bushing for distributing air directed to the bushing. The apparatus prevents leakage around the bushing and employs O-ring seals between the bushing and the shaft.

In an aspect of the present invention, an air driven device incorporates a bushing with O-ring seals therein. Leakage about the bushing is prevented by elements of the housing intruding into the bushing to be directly sealed by the sealing O-rings.

Accordingly, it is an object of the present invention to provide an improved apparatus for sealing. Other objects and advantages will appear hereinafter.

DETAILED DESCRIPTION OF THE PREFERRED EMBODIMENT

Figure 1:
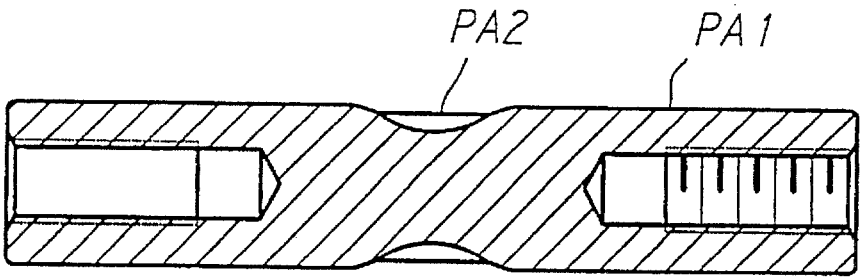
FIG. 1. (PRIOR ART)
FIG. 1 is a cross-sectional view of a prior art shaft.
Figure 2:
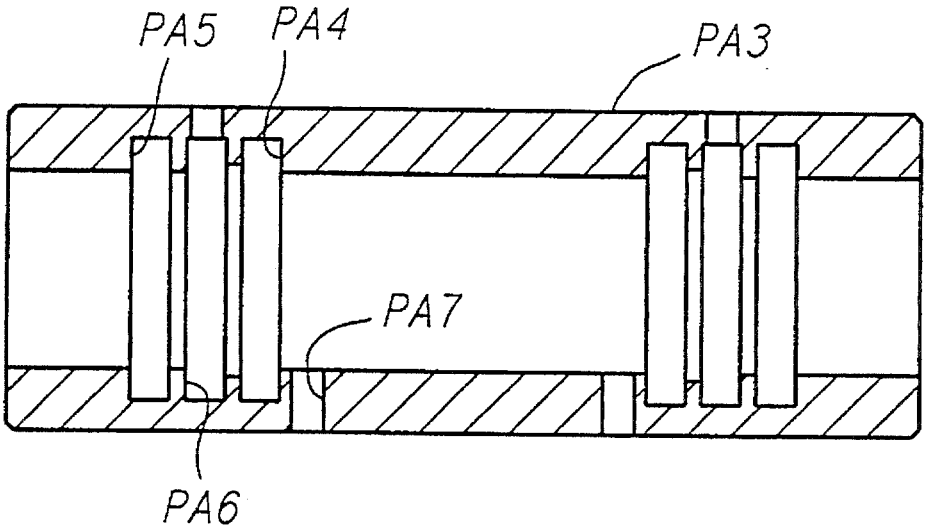
FIG. 2. (PRIOR ART)
FIG. 2 is a cross-sectional view of a prior art bushing.
Figure 3:
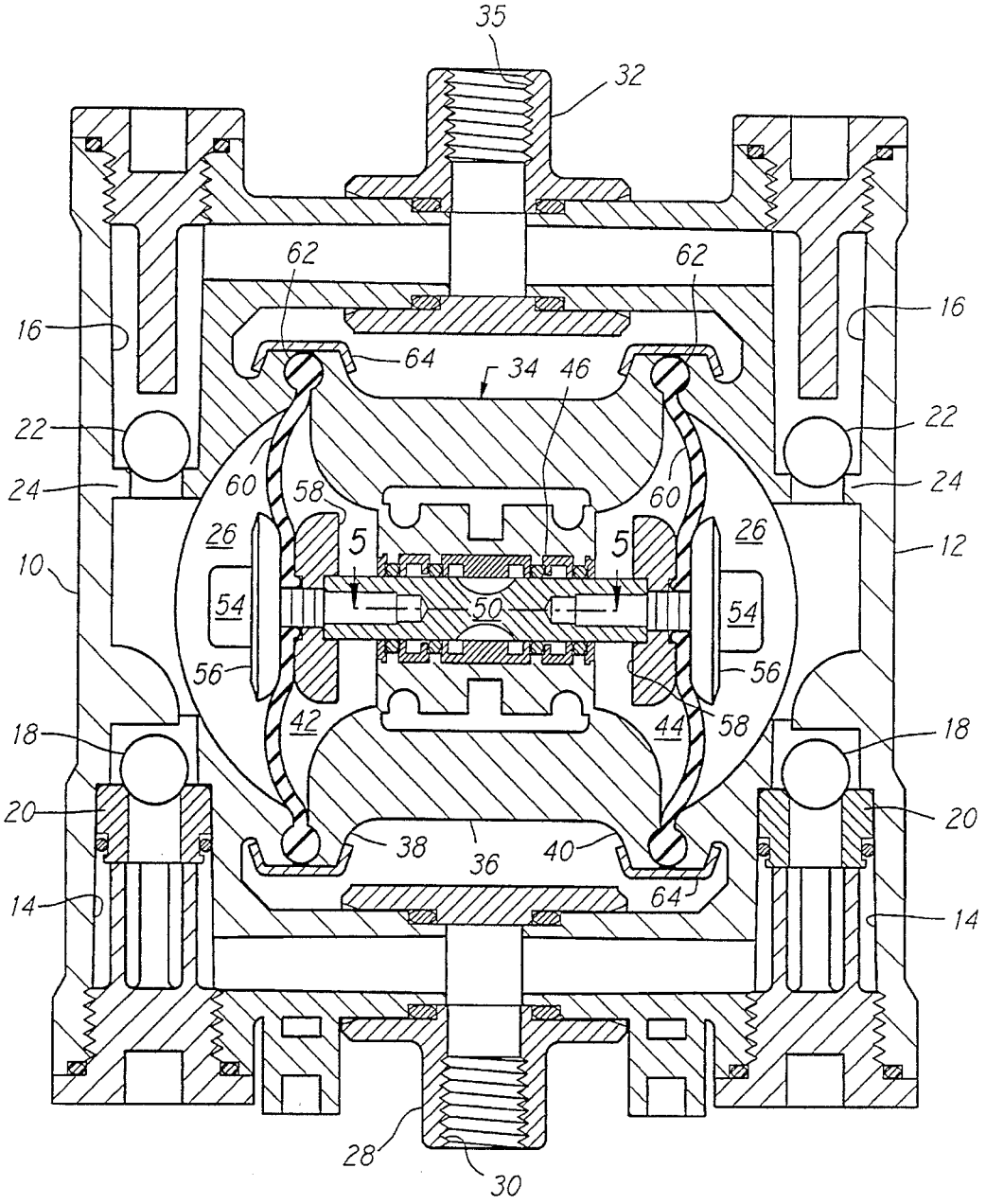
FIG. 3 is a cross-sectional view of an air driven diaphragm pump incorporating the present invention.
Figure 4:
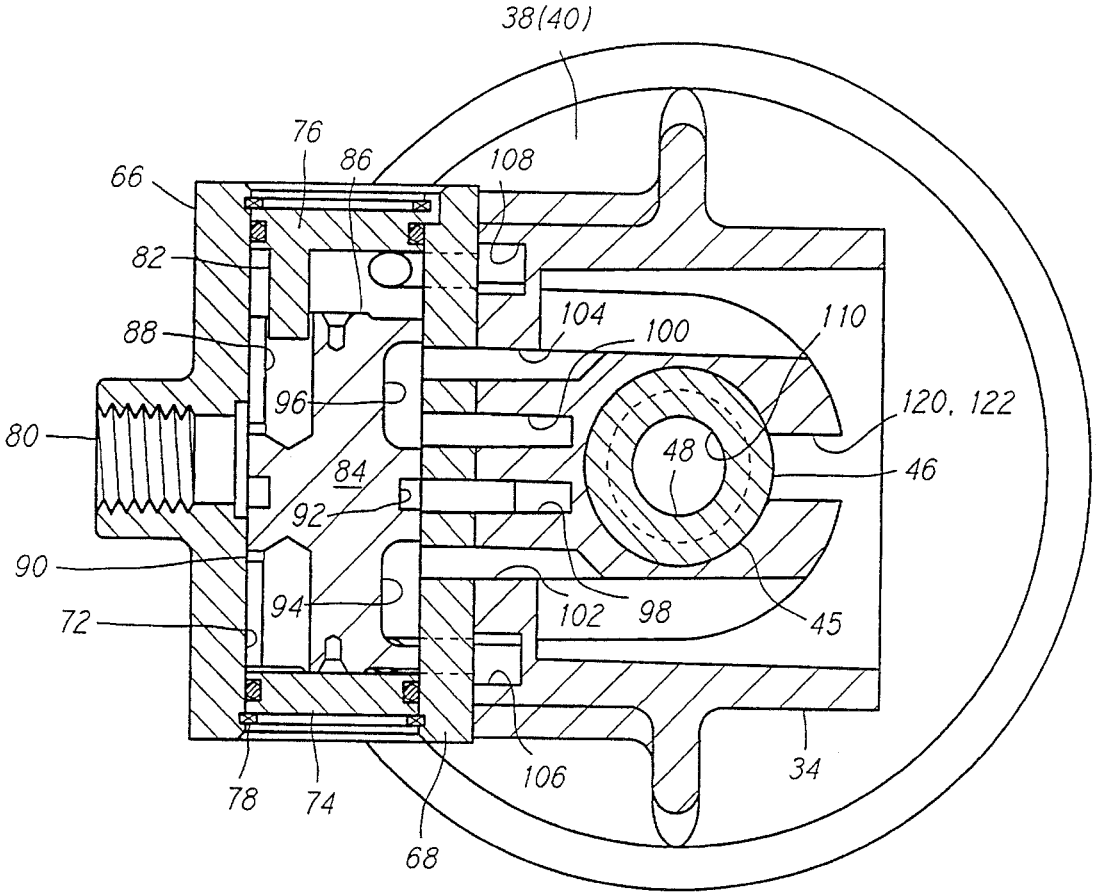
FIG. 4 is a cross-sectional view of an actuator valve associated with an air driven diaphragm pump.
Figure 5:
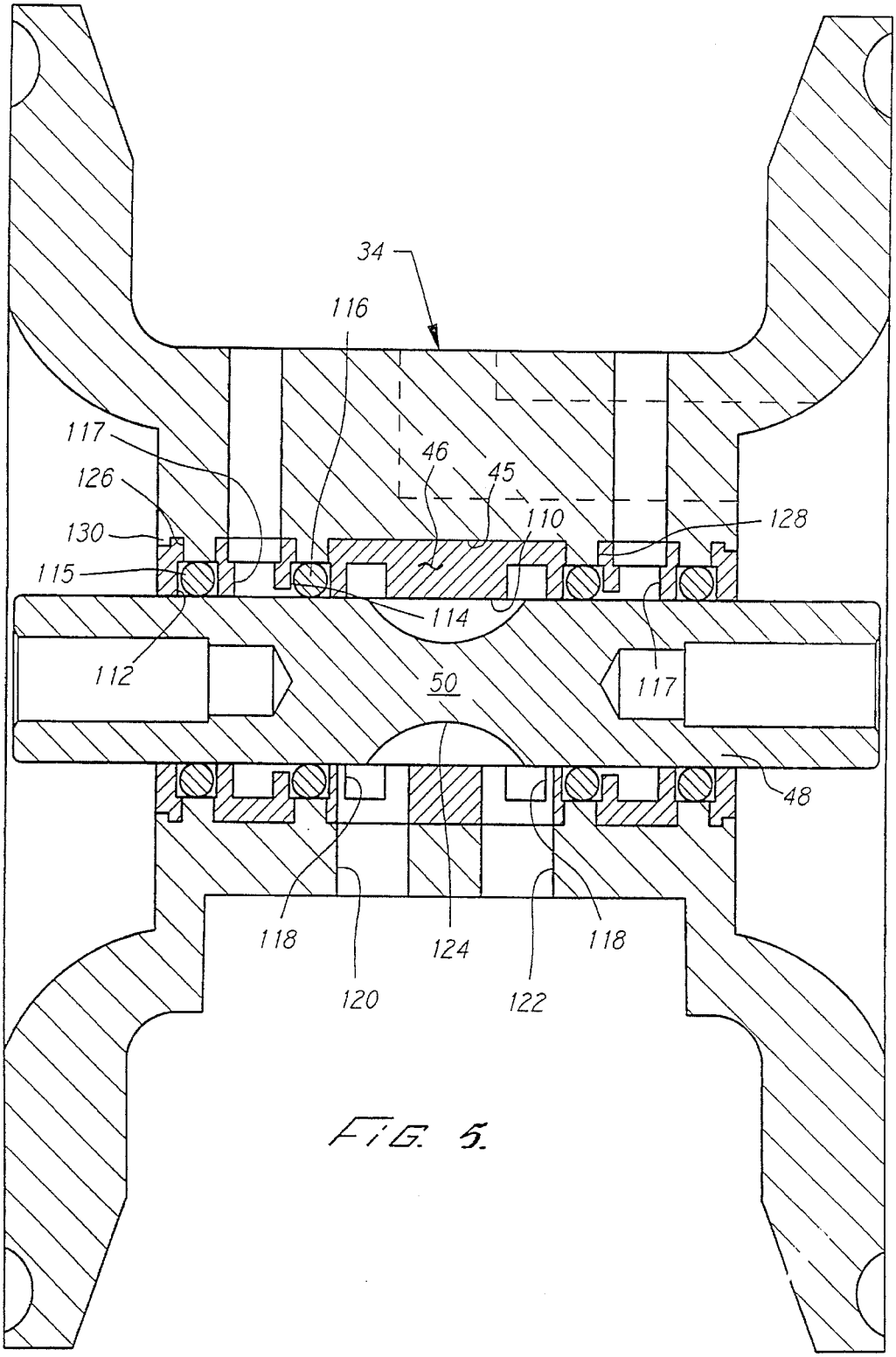
FIG. 5 is a cross-sectional view of a bushing and actuator housing taken along line 5—5 of FIG. 3.

Turning in detail to the drawings, FIGS. 1 and 2 represent prior art devices. FIGS. 3 through 5 illustrate a preferred embodiment of the present invention. The air driven double diaphragm pump is illustrated in central cross section in FIG. 3 as including two water chamber housings 10 and 12. The water chamber housings 10 and 12 are identical and each includes an inlet passage 14, an outlet passage 16, an inlet ball check valve 18 associated with a valve seat 20 and an outlet ball check valve 22 associated with a valve seat 24. A central cavity 26 is associated with a diaphragm to define a variable volume pump chamber in communication through the valves 18 ad 22 with the inlet 14 and outlet 16, respectively. Associated with the two inlets 14 of the water chamber housings 10 and 12 is an inlet tee 28 having an internally threaded inlet port 30 for receipt of a suction hose or the like. Similarly arranged with the outlet passages 16 is an outlet tee 32 which includes a similar port 35 for coupling with a discharge hose or the like.

Centrally located between the water chamber housings 10 and 12 is an actuator housing, generally designated 34. The actuator housing integrally includes a control shaft housing 36 located between air chamber members 38 and 40. The air chamber members 38 and 40 each define variable volume air chambers 42 and 44 with an associated diaphragm. The center section forming the control shaft housing 36 includes a bore 45 extending therethrough to receive a bushing 46.

Extending through the bushing 46 is a passageway 48 which receives a control shaft 50. The control shaft 50 has an axial passage, discussed in greater detail below, centrally located therein. At its outer ends, the control shaft 50 includes threaded end portions for the receipt of identical locking bolts 54 which hold mounting flanges 56 and 58 in position. Between the mounting flanges 56 and 58 at each end of the control shaft 50 are mounted flexible diaphragms 60. One such diaphragm is illustrated in U.S. Pat. No. 4,238,992 to Tuck, Jr., the disclosure of which is incorporated herein by reference. About the outer periphery of each of the flexible diaphragms 60 is a circular bead 62. The circular bead 62 is positioned in circular recesses located on each of the water chamber housings 10 and 12 and the air chamber members 38 and 40 of the actuator housing 34. Clamp bands 64 retain the diaphragms 60, the water chamber housings 10 and 12 and the actuator housing 34 in assembly.

The air driven double diaphragm pump is driven by pressurized air alternately being charged to and vented from each of the variable volume air chambers 42 and 44. Assuming the operating condition that the control shaft 50 is moving to the left in FIG. 3, the air chamber 42 would be in communication with the source of pressurized air while the air chamber 44 would be venting to atmosphere. This differential pressure operating on the diaphragms 60 forces the diaphragms 60 and in turn the control shaft 50 to move to the left. In doing so, the central cavity 26 in the water chamber housing 10 is being reduced by the displacement of the left diaphragm 60. At the same time, the central cavity 26 associated with the water chamber housing 12 is expanding. Thus, the water chamber housing 10 is experiencing an exhaust stroke while the water chamber housing 12 is experiencing a suction stroke. In the suction stroke, the ball valve 18 admits material to be pumped from the inlet passage 14. At the same time, the outlet ball valve 22 is seated to insure proper suction. In the exhaust stroke, the ball valve 18 is seated while the ball valve 22 is lifted for discharge of material within the central cavity 26. Through continued reciprocation of the diaphragms 60 and the control shaft 50, the two central chambers 26 alternately draw material to be pumped into the chamber and exhaust same. This type of pump has the capacity for pumping a wide variety of materials of widely varying viscosities and amounts of entrained solids.

To provide the alternating pressurized air and venting to the pump, an actuator valve is employed. The actuator valve is defined within an actuator housing which includes a valve housing 66 and the actuator housing 34. The valve housing 66 includes a generally cylindrical body having a mounting flange 68. The housing 66 is securely fastened to the front wall of the actuator housing 34 by fasteners. The housing 66 includes a valve cylinder 72. The valve cylinder is closed at each end by plugs 74 and 76 retained by spring clips 78. The spring clips 78 are set within grooves designed for this purpose. The plugs 74 and 76 include sealing O-rings positioned in peripheral grooves about each plug. An inlet 80 extends to the center of the valve cylinder 72 and is internally threaded for receipt of a shop air hose or the like. One of the plugs 76 includes a pin 82 extending into the main portion of the valve cylinder 72 for alignment purposes.

Located within the valve cylinder 72 is a valve piston 84. The valve piston 84 is arranged to slide within the cylinder 72 such that the piston 84 is capable of stroking back and forth from end to end within the cylinder. The piston 84 includes spacers 86 on either end thereof. These spacers 86 each define an annular cavity between the end of the piston 84 abutting against a plug 74, 76. The body of the valve piston 84 is sized such that clearance is provided between the wall of the cylinder 72 and the valve piston 84 to provide means for continuously directing air to the ends of the cylinder. The clearance is such that this flow of air axially between the piston 84 and the wall of the cylinder 72 is restricted. Pressure is accumulated over a short period of time prior to the next piston stroke but cannot flow so quickly as to prevent substantial venting of the cylinder at one or the other of the ends of the piston 84.

Longitudinal passages 88 extend from the near midpoint of the piston 84 to either end. Associated with these longitudinal passages 88 are pinholes 90 such that a volume of incoming air through the inlet 80 may be directed through one or the other of the pinholes 90 and the associated passage 88 to an end of the cylinder 72. Thus, only one of the pinholes 90 is ever exposed to the inlet 80 at a time such that incoming air is able to flow through only one of the pinholes 90 at a time when positioned in communication with the inlet 80 during a portion of the stroke. This arrangement enhances shifting. Conveniently, the pin 82 is sized and positioned within one of the longitudinal passages 88 to allow free air flow thereabout.

Located in an annular groove about the center of the valve piston 84 is an inlet passage 92. The width of the inlet 80 at the cylinder 72 is such that the inlet passage 92 is always exposed to the inlet. Thus, a constant source of air is provided to a location diametrically opposed to the inlet 80 across the piston 84. Located on the side of the piston 84 on the other side from the inlet 80 are two valve passages 94 and 96. These valve passages 94 and 96 extend axially along the piston 84 and are mutually spaced to either side of the inlet passage 92. In the preferred embodiment, these valve passages 94 and 96 are channels.

Defined within the cylinder 72 diametrically across from the air inlet 80 are two air chamber passages 98 and 100 and two exhaust ports 102 and 104. The air chamber passages 98 and 100 and the exhaust ports 102 and 104 extend through the valve housing 66 and through the actuator housing 34. The air chamber passages 98 and 100, the exhaust ports 102 and 104 and the end of the inlet passage 92 are axially aligned along the cylinder 72. As can best be seen in FIG. 4, the longitudinal passages 94 and 96 are able to selectively span across from one air chamber passage 98, 100 to an exhaust port 102, 104. Further, the air chamber passages 98 and 100 are arranged such that the inlet passage 92 is aligned with one or the other of these with the valve piston 84 located at one or the other of the ends of its stroke. Thus, at one end of the stroke of the piston 84, the inlet passage 92 is in communication with the air chamber passage 98 and the valve passage 96 is in communication at its ends with the air chamber passage 100 and the exhaust port 104. The valve passage 94 is in communication with the exhaust port 102 to no effect. The air chamber passages 98 and 100 each extend to one of the variable volume air chambers 42 and 44. Consequently, one air chamber is pressurized by being in communication with the inlet passage 92 through the air chamber passage 98 while the other air chamber is exhausted through the air chamber passage 100, the valve passage 96 and the exhaust port 104. By shifting the valve 84, the process is reversed.

Extending from adjacent each end of the valve chamber 72, shift passages 106 and 108 are arranged for controlling the valve piston 84. These shift passages 106 and 108 extend through the valve housing 66 and the actuator housing 34. Each shift passage 106 and 108 is defined by two passageways which are mutually displaced one from another in the valve housing 66 and are located adjacent an end of the valve cylinder 72 at the plugs 74 and 76. The passageways of the shift passages 106 and 108 are joined in the control shaft housing 36.

The bushing 46 includes four annular channels about the passageway 48 to either side of a central bearing surface 110. In each set of four annular channels, there are two sealing channels 112 and 114 which retain O-rings 115 and 116 to form annular seals about the control shaft 50. Between the two sealing channels 112 and 114 on either end of the bushing 46, annular channels 117 communicate with shift passages 106 and 108, respectively. Inwardly of the sealing channels 114 is an annular channel 118 on either end of the bushing. These annular channels 118 are in communication with vent passages 120 and 122 which vent to atmosphere. Thus, when communication is created between either one of the annular channels 117 and an annular channel 118 through axial slots 124 in the control shaft 50, a shift chamber at either end of the piston 84 is vented to shift the piston to the other end of the valve cylinder 72. This shifting occurs because of the differential pressure between the vented end and the unvented end of the piston 84 where pressure has accumulated.

The bushing 46 is shown to extend the full length of the bore 45 through the housing 34 but is divided into five rings by annular flanges extending inwardly from the actuator housing 34. The actuator housing 34 includes two pairs of annular flanges 126 and 128 in the bore 45. These flanges 126 and 128 extend radially inwardly into the bushing 46 to meet the annular sealing channels 112 and 114, respectively. Smaller, retaining flanges 130 extend inwardly from the actuator housing 34 into the bore 45 at the ends of the bushing 46 to retain the ends thereof. The annular sealing channels 112 and 114 include opposite sidewalls which extend outwardly from the passageway 48 to a channel floor which includes the inwardly extending annular flange 126 and 128, respectively.

The fabrication of the bushing and housing arrangement is accomplished by molding the housing 34 about the bushing 46. The bushing includes outer annular channels such that the housing 34 when molded in place will include the inwardly annular flange 126 within the bore 45. The annular channels 112 and 114 are cut to create the composite channels defined by both the housing 34 and the bushing 46 as illustrated.

As can be seen from the detail of FIG. 5, the O-rings 115 and 116 are positioned within the annular sealing channels 112 and 114, respectively. In this position, they contact and seal with the shaft 50. They also contact and seal against the housing 34. This occurs to either side of the selectively pressurized passages defined by the annular channels 117 and 118. Thus, even if the bushing 46 is loose within the housing 34, sealing is against the housing 34; and the rings of the bushing cannot slide within the housing 34. The portions of the housing which extend inwardly at the ends of each ring of the bushing 46, the flanges 126 and 128 and the retaining flanges 130, prevent movement.

To provide communication selectively between sets of annular channels 117 and 118 for shifting the piston 84, the control shaft 50 includes a central cylindrical portion containing the axial slots 124. The axial slots 124 are mutually angularly spaced apart and are located at a common axial position along the control shaft 50 and are also of common extent such that they act uniformly across the seal in annular channel 114, and connect the two shifting channels 117 and 118. Any number of such slots may be provided and are most appropriately equiangularly placed. The central cylindrical portion of the control shaft 50 is fully cylindrical, including between axial slots 124. This provides a uniform cylindrical surface upon which the annular seals defined by the O-rings 115 and 116 slide. By having the axial slots 124 associate with both an annular channel 117 to manifold venting air to the slots and the annular channel 118 to manifold air from the slots 124 to atmosphere, sufficient air flow is achieved to allow shifting of the piston 84 without substantial resistance. Free shifting is helpful to avoid the possibility of stalling the piston between positions. The cylindrical nature of the central portion of the control shaft 50 provides for O-ring longevity and permits the use of relatively soft O-ring material, 70 shore.

In operation, pressurized air is provided to the inlet 80. Normally the valve piston 84 is found in its lower position due to gravity prior to activation of the pump. Such a position of starting is illustrated in FIG. 4. Both ends of the valve cylinder 72 are pressurized, through the passageways and through the tolerance about the valve piston 84. Pressurized air is also conveyed through the inlet passage 92 to the air chamber passage 98. Air is directed through the passage 98 to the variable volume chamber 44 to force the diaphragm 60 further into the central cavity 26 to the right as seen in FIG. 3. Thus, pumping action is initiated with a pressure stroke on the right and a suction stroke on the left as seen in FIG. 3. When the control shaft 50 advances to the point that the axial slots 124 span the O-ring 116, the shift passage 108 communicates with the vent through passage 122. Once such communication is established, the cavity at the upper end of the valve cylinder 72 is vented and the compressed air at the other end of the valve cylinder 72 drives the piston 84 upwardly to the other end of its stroke. Venting through the shift passage 108 must exceed the flow through the upper pinhole 90 and the flow around the piston 84 through the clearance with the cylinder 72. In this way, pressure is reduced at the upper end of the cylinder and the pressure remaining at the closed end of the cylinder is able to force the piston through its stroke. Once it reaches just past midstroke, the lower pinhole 90 further contributes air to the lower, closed end of the valve cylinder 72. Once shifted, air to and from the double diaphragm pump is reversed. Incoming air now is directed through the inlet passage 92 to the air chamber passage 100 which is directed to the variable volume air chamber 42 on the left side of the pump as seen in FIG. 3. Thus, the left central cavity experiences a pressure stroke while the right central cavity experiences a vacuum stroke. Eventually the control shaft 50 proceeds such that the axial slots 124 span the O-ring 116 and the cycle is then repeated. Venting of the ends of the valve chamber are enhanced with increased flow for shifting.

Accordingly, an improved method and apparatus for an air driven diaphragm pump is disclosed. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. An air driven device comprising a housing having a bore therethrough;

a bushing extending in said bore and having a passageway therethrough and an annular channel within said passageway, said annular channel having opposed sides, said housing including an annular flange extending radially inwardly into said bore to said annular channel between said opposed sides, said bushing abutting against said flange on each side of said flange;

a first O-ring in said annular channel contacting said flange;

a control valve including a control passage between said valve and said passageway;

a vent passage extending from said passageway to atmosphere, said annular channel being between said control passage and said vent passage;

a shaft slidably extending through said passageway and having an axial passage selectively extendable between said control passage and said vent passage.

2. The air driven device of claim 1 further comprising an outer annular channel in said passageway, said housing further including an outer annular flange extending inwardly into said bore to said outer annular channel, said outer annular channel being defined by an end of said bushing and by said housing outer annular flange outwardly of said annular channel, said bushing abutting against a side of said outer annular flange;

a second O-ring in said outer annular channel contacting said housing.

3. The air driven device of claim 2 the control passage being selectively pressurized and extending to said passageway between said annular channel and said outer annular channel.

4. The air driven device of claim 1 the control passage being selectively pressurized and extending to said passageway through said housing and said bushing and displaced axially from said annular channel.

5. An air driven device comprising a housing having a bore therethrough;

a bushing extending in said bore and having a passageway therethrough, said housing including an annular flange extending radially inwardly into said bore and into said bushing, said bushing abutting against said flange on each side of said flange, an annular channel cut into said bushing from said passageway to form opposed sides and to expose said annular flange between said opposed sides;

a first O-ring in said annular channel contacting said flange;

a control valve including a control passage between said valve and said annular channel;

a vent passage extending from said passageway to atmosphere, said annular channel being between said control passage and said vent passage;

a shaft slidably extending through said passageway and having an axial passage selectively extendable between said control passage and said vent passage.

6. The air driven device of claim 5, said housing extending outwardly of said annular flange along said passageway, the air driven device further comprising an outer annular channel cut into said bushing from said passageway to be defined by an end of said bushing and by said housing outwardly of said annular channel;

a second O-ring in said outer annular channel contacting said housing.

7. The air driven device of claim 6 the control passage being selectively pressurized and axially in said passageway between said annular channel and said outer annular channel.

8. The air driven device of claim 5 the control passage being selectively pressurized and extending to said passageway through said housing and said bushing and being displaced axially in said passageway of said annular channel.

9. An air driven device comprising a housing having a bore therethrough;

a bushing extending in the bore and having a passageway therethrough and an annular channel within the passageway, the annular channel having opposed sides, the housing including an annular flange extending radially inwardly into the bore to the annular channel between the opposed sides, the bushing abutting against the flange on each side of the flange;

a first O-ring in the annular channel contacting the flange;

a selectively pressurized control passage extending to the passageway;

a vent passage extending from the passageway to atmosphere, the annular channel being between the control passage and the vent passage;

a shaft slidably extending through the passageway and having an axial passage selectively extendable between the control passage and the vent passage.

10. The air driven device of claim 9 further comprising an outer annular channel in the passageway, the housing further including an outer annular flange extending inwardly into the bore to the outer annular channel, the outer annular channel being defined by an end of the bushing and by the housing outer annular flange outwardly of the annular channel, the bushing abutting against a side of the outer annular flange;

a second O-ring in the outer annular channel contacting the housing, the control passage extending to the passageway between the annular channel and the outer annular channel.

* * * * *